United States Patent [19]

Fort et al.

[11] 4,049,043

[45] Sept. 20, 1977

[54] INSTALLATION FOR EXTRACTING PIPES FROM A CENTRIFUGAL CASTING MACHINE

[75] Inventors: Pierre Henri Marie Fort, Nancy; Michel Pierrel, Pont-a-Mousson, both of France

[73] Assignee: Pont-A-Mousson S.A., Nancy, France

[21] Appl. No.: 590,739

[22] Filed: June 26, 1975

[30] Foreign Application Priority Data

July 8, 1974 France ..... 74.23701

[51] Int. Cl.[2] ..... B22D 13/02; B22D 13/10

[52] U.S. Cl. ..... 164/295; 164/298; 214/338; 294/106

[58] Field of Search ..... 164/131, 295, 298–301, 164/404; 425/267, 402, 436, 444; 264/334, 336; 214/338; 294/106

[56] References Cited

U.S. PATENT DOCUMENTS

| | | | |
|---|---|---|---|
| 121,386 | 11/1871 | Krausch | 294/117 |
| 1,758,883 | 5/1930 | Camerota | 164/404 |
| 2,586,349 | 2/1952 | Kurtz | 164/298 X |
| 3,797,686 | 3/1974 | Jarvis | 214/338 |

FOREIGN PATENT DOCUMENTS

| | | | |
|---|---|---|---|
| 933,166 | 9/1955 | Germany | 164/295 |
| 9,262 | 10/1956 | Germany | 164/295 |

*Primary Examiner*—Robert D. Baldwin

*Attorney, Agent, or Firm*—Sughrue, Rothwell, Mion, Zinn and Macpeak

[57] ABSTRACT

This installation has an extracting carriage provided with an extracting tongs. The extracting carriage is provided with means for driving the extracting tongs in rotation at the same speed as the mould. Consequently, in the extraction of large diameter cast iron pipes not intended to be annealed there is no risk of the pipes becoming oval.

8 Claims, 13 Drawing Figures

INSTALLATION FOR EXTRACTING PIPES FROM A CENTRIFUGAL CASTING MACHINE

The present invention relates to an installation for extracting from a centrifugal casting machine by means of an extracting tongs pipes and in particular cast iron pipes not intended to be annealed.

It is known that under certain casting conditions the annealing of the pipes can be dispensed with. This is for example the case when the casting mould is provided internally with a thick coating of a "wet-spray" mixture of silica and bentonite in suspension in water and the iron is inoculated with ferro-silicon poured into the iron in the pouring channel or with calcium silicide covering said coating.

The absence of annealing is very advantageous in the manufacture of the pipes but in this case there is a high risk of the pipes cast in this way becoming oval above all if the pipes have a large diameter. This risk of ovalization exists when the pipe is extracted from its casting mould owing to the fact that it is seized internally by an extracting tongs and brought to support rollers for discharging the pipe while it is still red hot and therefore malleable.

An object of the invention is to provide an installation for extracting cast iron pipes from a rotary mould of a centrifugal casting machine which overcomes this risk of ovalization. The installation according to the invention comprises an extracting carriage movable parallel to the axis of the mould, pipe extracting tongs coaxial with the mould and carried by the carriage, and a motor carried by the carriage and drivingly connected to the extracting tongs for driving the extracting tongs in rotation about said axis.

By means of the invention the pipe is extracted from its mould and discharged without ceasing to rotate about its axis and while undergoing the minimum of friction. Thus, it has practically no tendency to become oval even in respect of very large pipe diameters.

Further features and advantages of the invention will be apparent from the ensuing description with reference to the accompanying drawings given solely by way of example and in which:

FIG. 1 is a diagrammatic perspective view of the assembly of an installation according to the invention, a pipe being extracted from its casting mould;

FIGS. 2, 3, 4, and 5 are diagrammatic elevational views, with a part in vertical section, illustrating the different stages of the pipe-extracting process;

Figure 1:
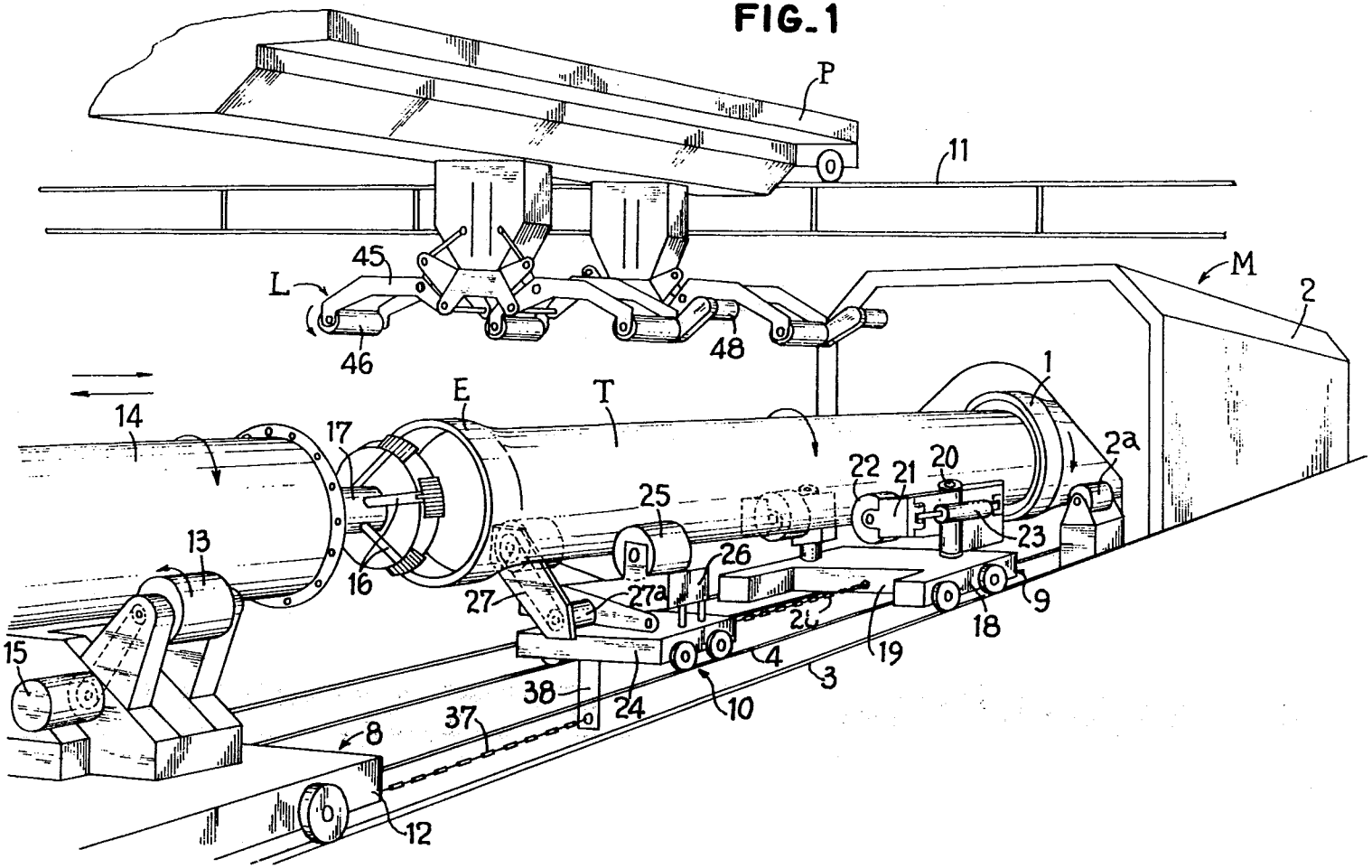

The pipe extracting and discharging installation shown in the drawings is applied to a centrifugal casting machine M for casting iron pipes T of large diameter (600 to 2000 mm) having a socket E. The machine M mainly comprises a rotary casting mould 1 having an horizontal axis X—X disposed in a spacious casing 2 and carried by rollers $2^a$ at least one of which rollers (for example the roller $2^a$ visible in FIG. 1) is a driving roller. The machine M further comprises a pouring ladle and channel (not shown).

In the extension of the casing 2 the installation comprises two runways, namely a runway 3 having a wide track, and a runway 4 having a narrower track, parallel to the axis X—X and located at the same height, which is substantially that of the base of the casing 2. Each of these runways is constituted by two rails. The runway 4 comprises at the end thereof in the vicinity of the mould 1 a pivotal track section 5 capable of being lowered substantially below the level of the runway 4 (FIG. 2) and raised to this level (FIG. 3) under the action of at least one jack 6 whose body $6^a$ is pivoted at a fixed point 7, the end of the piston rod of this jack being pivoted to the section 5 of the runway 4.

The runway 3 carries two carriages, namely a pipe extracting carriage 8 and a first support carriage 9 disposed between the latter and the casing 2. The runway 4 merely carries a second support carriage 10 disposed between the two other carriages.

This installation is completed by a hoisting assembly L carried by an overhead crane P which moves in a direction perpendicular to the axis X—X along a runway 11 disposed above the machine M and the runways 3 and 4.

The extracting carriage 8 mainly comprises a support 12 mounted on four wheels and provided with rollers 13 whose axes are all parallel to the axis X—X. These rollers 13 support and guide a tubular girder 14 and at least one roller may be driven in rotation by an individual motor 15. The tubular girder 14 is connected to move in translation with the carriage 8 and carries at the end thereof adjacent the casing 2 a series of jaws 16 which are circumferentially evenly spaced apart and connected to rotate with the girder 14. These jaws 16 constitute an extracting tongs and may be moved simultaneously away from or toward the axis X—X of the mould 1 by means of a control rod 17 which is slidable in the girder 14 coaxially of the latter. Thus, when the jaws 16 are introduced inside the pipe which has just been cast and radially expanded, they all simultaneously bear against the wall of this pipe and provide an internal hooking device for the latter.

The carriage 8 is movable in both directions along the runway 3 by means of any known drive device (not shown), for example by means of endless chains which extend around a winch and are hooked to the carriage.

The first support carriage 9 comprises four wheels, a planar generally rectangular platform 18 having on the side thereof opposed to the casing 2 a rectangular recess 19 whose width is of the same order of magnitude as that of the runway 4. The platform 18 carries laterally on each side a vertical pivot 20 on which there is pivotally mounted a bracket 21 which carries a roller 22 having a horizontal axis. The two rollers 22 are movable by means of jacks 23 between a withdrawn position (FIG. 6) in which their axes are in the extension of each other and perpendicular to the axis X—X and an operative support position (FIG. 1) in which their axes are parallel to the axes X—X. The jacks 23 therefore impart to the pivotal brackets 21 a movement of rotation through 90° so as to move the rollers from their operative position to their withdrawn position and vice versa.

Figure 2:
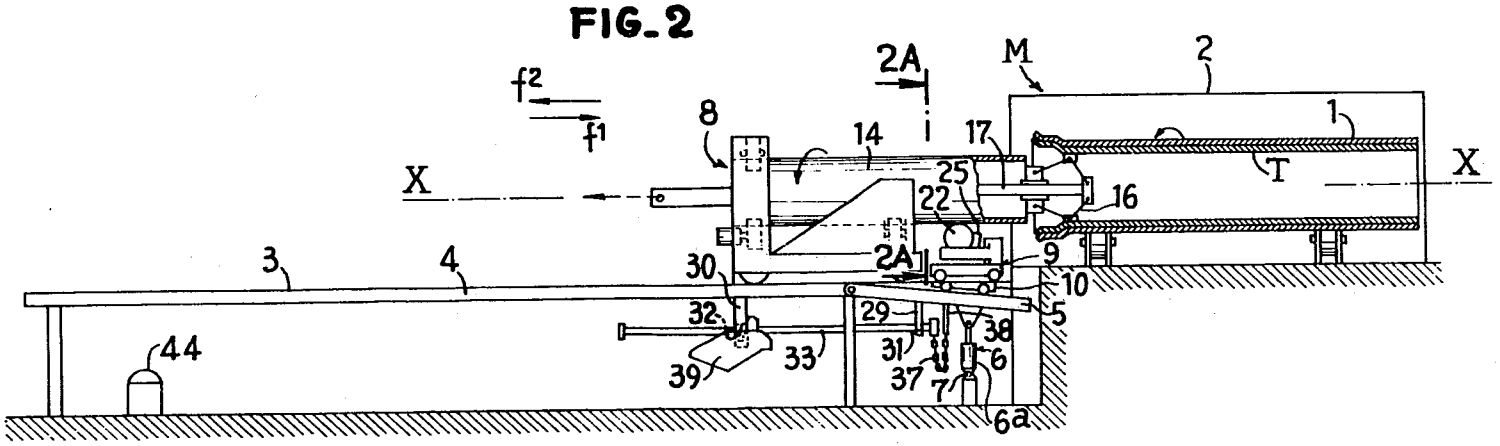
FIGS. 2A, 3A, 4A are partial diagrammatic cross-sectional views taken on line 2A—2A, 3A—3A, 4A—4A of FIGS. 2, 3 and 4 respectively, illustrating the successive relative positions of the two support carriages for an extracted pipe.
Figure 6:
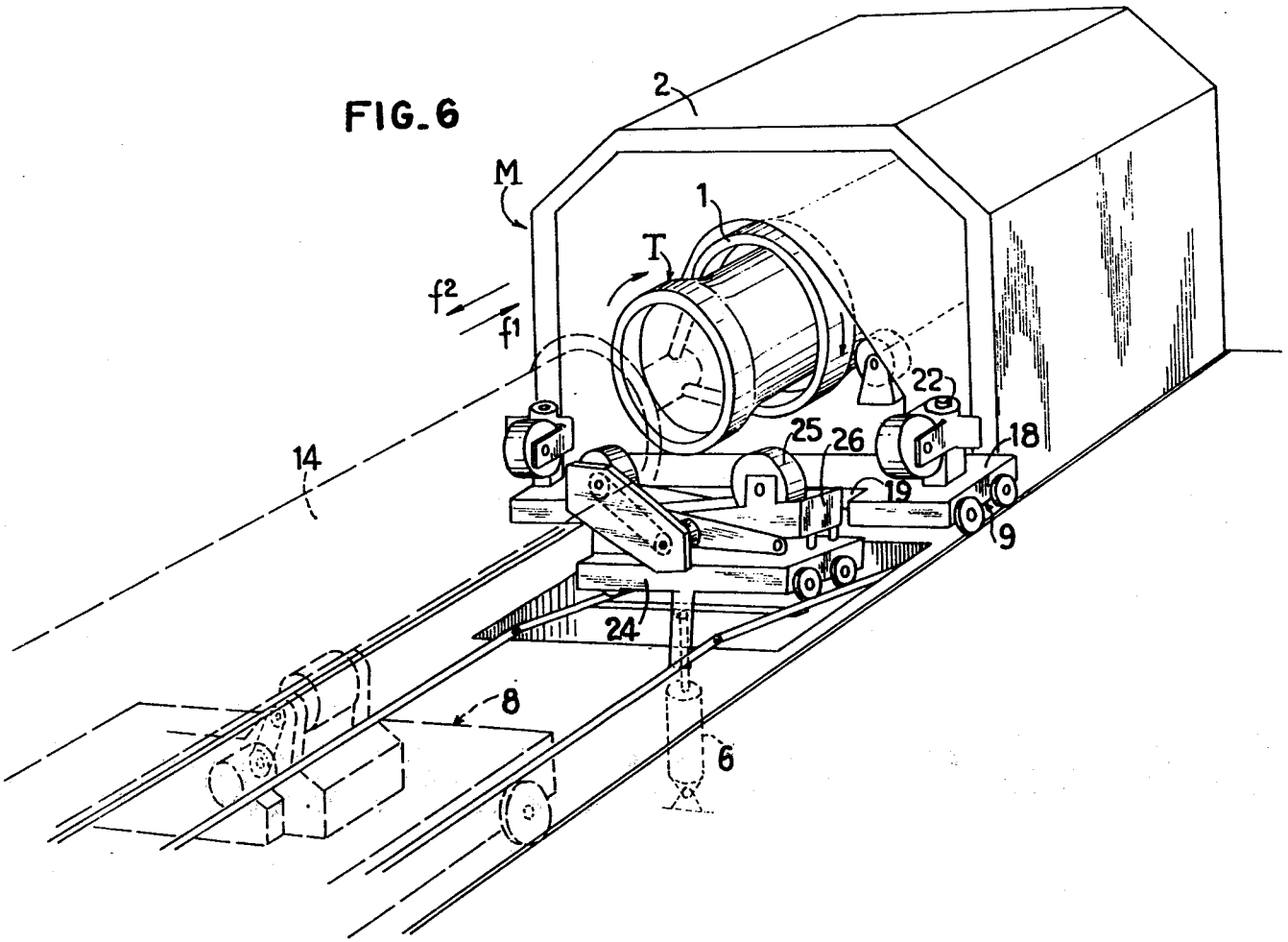
FIG. 6 is a partial perspective view similar to FIG. 1 or a pipe in the course of extraction and the relative positions of the two support carriages.

The second support carriage 10 comprises a planar rectangular platform 24 mounted on four wheels and carrying two support rollers 25 having axes parallel to the axis X—X. The lower part of these rollers 25 is protected by a frame 26 having a generally rectangular shape in plan and dimensions slightly less than the corresponding dimensions of the platform 24. One of the rollers 25 may be driven in rotation by a chain or transmission belt 27 which connects it to a motor 27*a* carried by the carriage 10.

when the first support carriage 9 is at the end of the runway 3 and the second support carriage 10 is on the section 5 of the runway 4, retraction of the jack 6 lowers the section 5 and moves it downwardly away from the second carriage 10. The latter by its own weight then disposes itself in the recess 19 of the first carriage 9, the frame 26 of the carriage 10 fitting itself in this recess 19 (FIGS. 2 and 6).

The three described carriages are interconnected in the following manner:

A simple chain 28 connects the facing ends of the platforms 18 and 24 of the two support carriages 9 and 10. The carriage 10 is connected to the extracting carriage 8 by an automatic coupling which will now be described with reference to FIGS. 2, 3, 8, 9 and 10.

The extracting carriage 8 is provided at each end thereof with a vertical girder 29, 30 which extends downwardly and is provided respectively with an aperture 31, 32 having an axis parallel to the axis X—X, the apertures 31 and 32 being in alignment with each other. The reference numeral 30 designates the vertical girder located at the end of the carriage 8 opposed to the casing 2.

Figure 3:
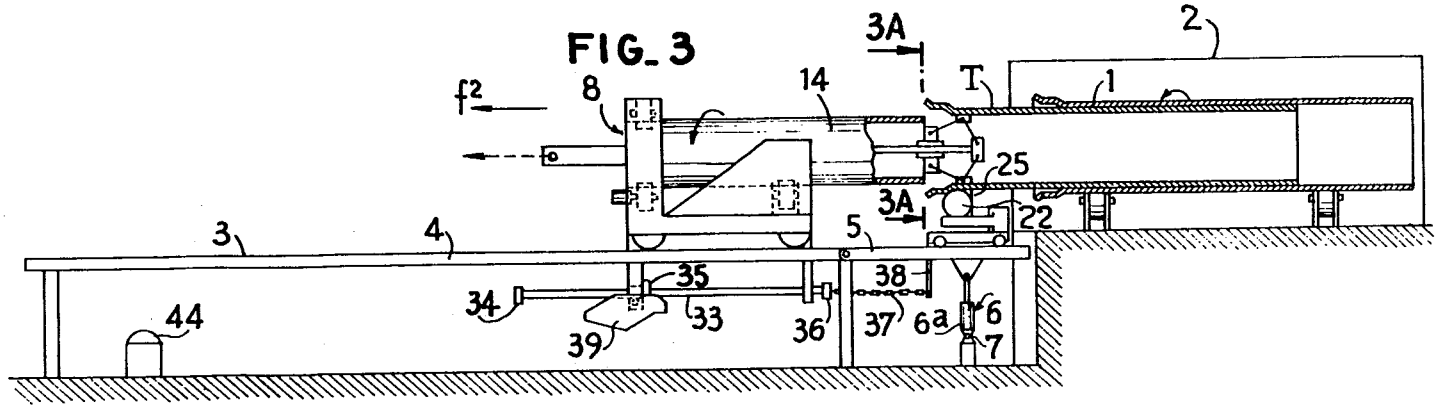
Figure 8:
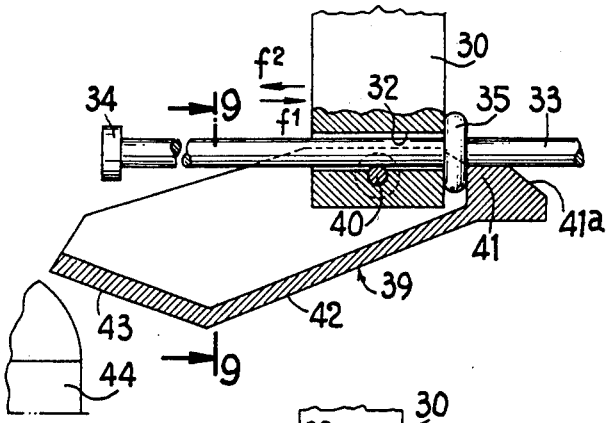
FIG. 8 is a sectional detail view of an automatic coupling device for the extracting carriage, shown in the hooked position.
Figure 9:
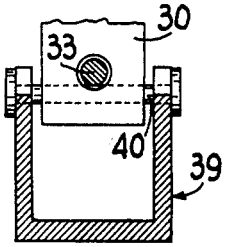
FIG. 9 is a view of the device shown in FIG. 8 taken on line 9—9 of FIG. 8.

A horizontal bar 33 is slidably mounted in the two apertures 31 and 32 and its movement is limited by an end flange 34 and a flange 35 disposed roughly in the middle of this bar, these two flanges being capable of abutting each side of the girder 30. The end of the bar 33 adjacent the casing 2 is provided with a fork 36 which is connected by a chain 37 to a vertical plate 38 which is fixed under the support carriage 10 (FIG. 3). Moreover, the fork 36 is acted to cooperate with this plate 38 so as to be able to push the carriage 10 through the medium of this plate 38.

A coupling shoe 39 is pivotally suspended from the lower end of the girder 30 by a transverse pin 40 which is fixed to this girder 30 below the aperture 32 of the latter. This shoe 39 (FIGS. 8 to 10) has a hollow U-shaped cross section which extends round the lower end of the girder 30 and allows the passage of the bar 33. It has adjacent the casing 2 a hook 41 having an engaging ramp 41*a*, this hook being extended by a slightly descending slope 42 followed by a slightly rising slope 43 so that the shoe 39 has in longitudinal section the shape of a very open V. The balancing of the shoe is such that the hook 41 constantly bears against the bar 43. The rising part 43 of the shoe is adapted to cooperate with a fixed abutment 44 provided at the end of the runway 3 opposed to the casing 2.

Figure 10:
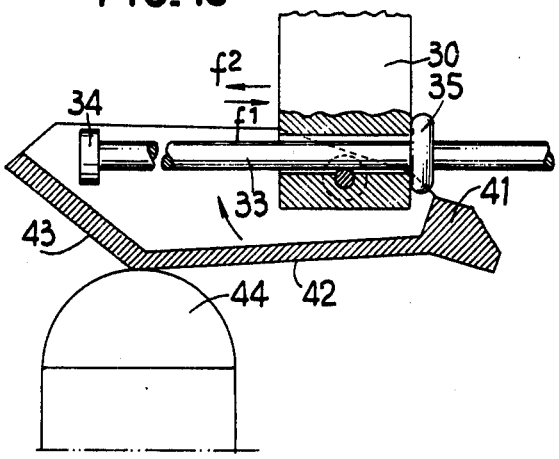
FIG. 10 is a view similar to FIG. 8, the device being shown in the unhooked position thereof.

It will be understood that when the bar 36 moves in the direction $f^2$ (FIG. 8) with respect to the girder 30, the flange 35 of this bar encounters the ramp 41*a* of the hook, then in abutting against the girder 30, locks itself behind the other face of this hook 41. When after this locking and consequently the coupling of the carriage 10 to the extracting carriage 8 is thus achieved and the extracting carriage 8 is moved in the direction of arrow $f^2$ to the end of the runway 3, the rising face 43 of the shoe 39 encounters the fixed abutment 44 and is raised by the latter and tips the shoe 39 about the pin 40 and releases the flange 35 of the bar 33 (FIG. 10). A continued movement of the carriage 8 in the direction of arrow $f^2$ then no longer results in any movement of the bar 33. The latter moves in the direction $f^1$ with respect to the girder 30 until the other flange 34 of the bar is in contact with the girder 30.

The hoisting assembly L comprises four seizing tongs 45 which are openable and provided at their ends with support rollers 46 which may be driven in rotation by individual motors 48. The axes of the rollers 46 are parallel to the axis X—X and the tongs 45 move in planes perpendicular to the axis X—X.

The various control means, synchronizing means and actuating means of the various moving parts known per se have not been shown in the drawing for reasons of clarity.

The installation described hereinbefore for extracting a pipe T from the casting mould 1 and discharging the pipe is employed in the following manner:

It will be assumed that, at the start, a pipe T has just been cast in the mould 1 and that it is in process of solidifying, the mould 1 being driven in rotation.

Figure 5:
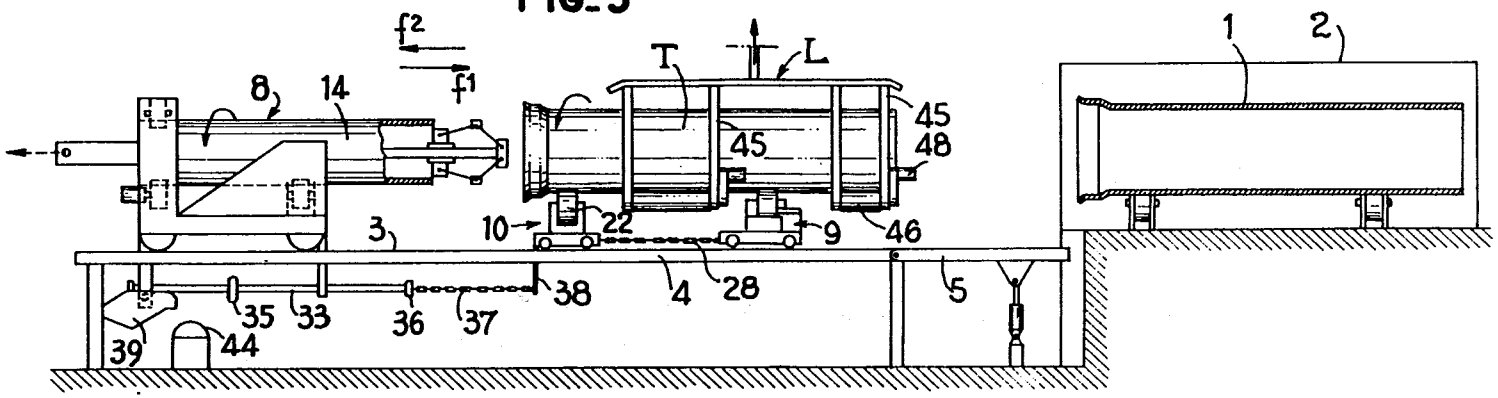

The carriages 8, 9 and 10 are in the position shown in FIGS. 1 and 5, that is to say the position they retained after the extraction and discharge of the previously cast pipe T. In this position, the extracting carriage 8 is near to the end of the runway 3 which carries in its median part the support carriage 9 whose rollers 22 are in the operative position (jacks 23 extended); the carriage 10 is located on the fixed part of the runway 4. The jaws 16 are withdrawn and the coupling tool 39 does not maintain the flange 35 of the bar 33 by its hook 41.

Figure 2A:
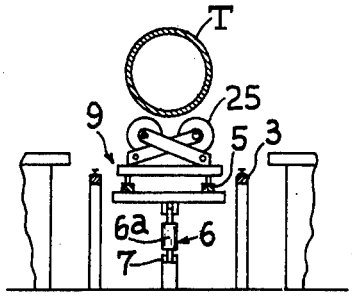
Figure 3A:
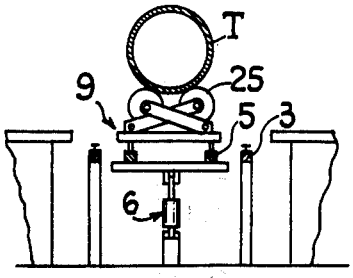
Figure 7:
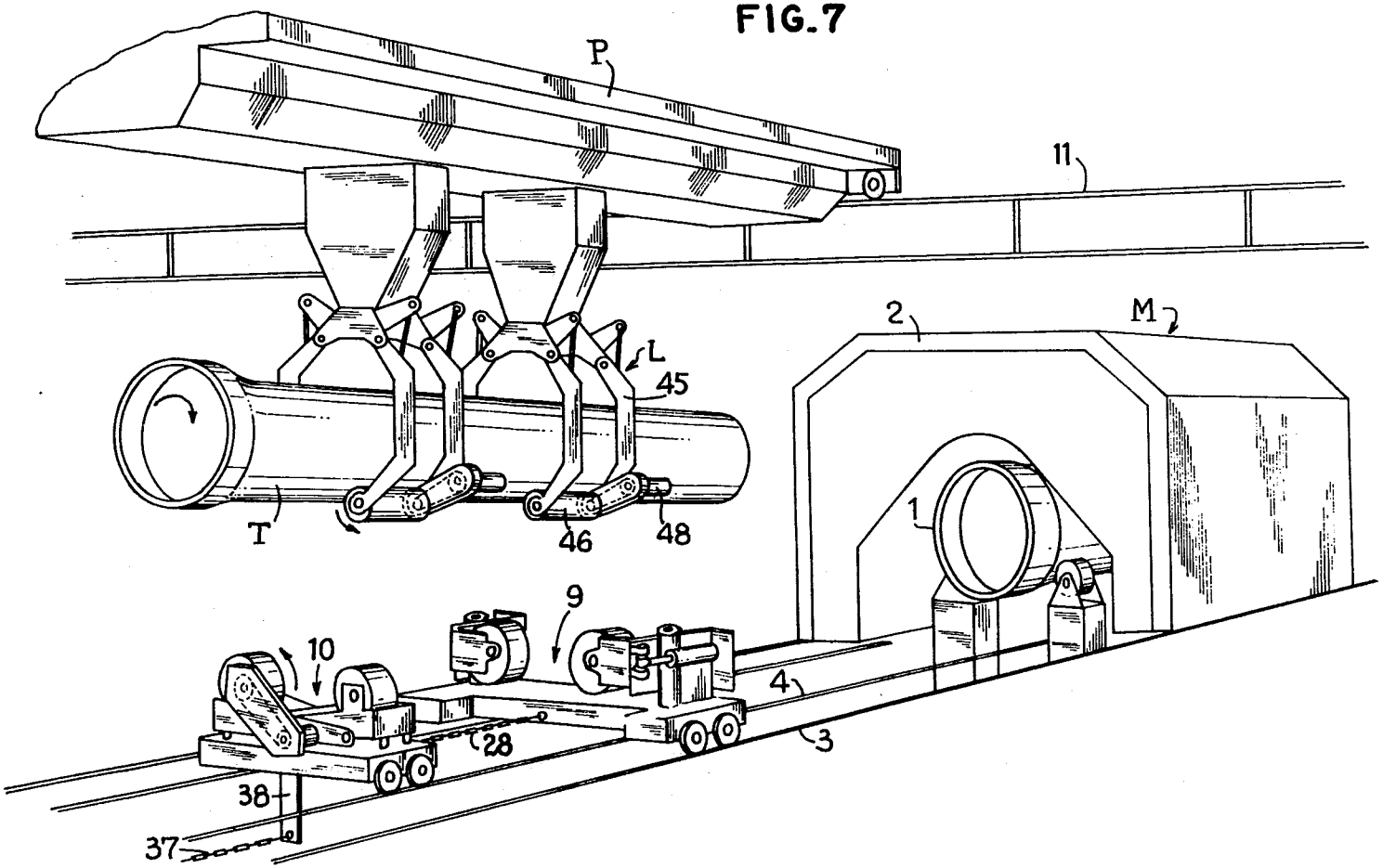
FIG. 7 is a perspective view similar to FIG. 1 of a pipe discharged by a hoisting apparatus and the positions of the two support carriages.

The pipe is extracted and discharged from the mould in the following stages:

a. Approach of the extractor 8 relative to the mould 1 and seizure of the pipe T by the extracting tongs (FIGS. 2, 2A).

b. Extraction of the pipe T from the mould (FIGS. 1, 3, 3A, 4, 4A and 6).

c. Discharge of the pipe T (FIG. 7).

During all the stages of the process which will now be described, the tubular girder 14 of the extracting carriage 8 is driven in rotation by the motor 15 at the same rotational speed as the centrifugal casting mould 1. Likewise, the rollers 46 of the hoisting apparatus L and one of the support rollers 25 of the carriage 10 are permanently driven in rotation by their respective motors at a rotational speed which corresponds to their slipless rolling along the pipe T which rotates at the speed of the mould 1.

a. Approach of the extractor 8 and seizure of the pipe T.

When the internal colour of the pipe T indicates that the latter has cooled sufficiently, the operator removes the rigid ring supporting the socket core (not shown) and moves the extractor 8 forwardly in the direction of arrow $f^1$.

At the start of its movement, the carriage 8 drives, under the effect of friction, the coupling bar 33 in the direction of arrow $f^1$ but travels faster than this bar. When the fork 36 reaches the abutment plate 38 of the carriage 10 the bar 32 ceases to move and the bar consequently moves in the direction $f^2$ with respect to the carriage 8. This relative movement continues until the flange 35 of the bar 33 comes in contact with the vertical girder 30 after having been engaged behind the hook 41 of the shoe 39, as explained hereinbefore, which couples the carriage 10 with the carriage 8. The purpose of this coupling will be clear hereinafter.

The departure of the carriage 8 simultaneously and automatically causes the opening of the support rollers 22 of the carriage 9 to the withdrawn position.

With carriage 8 travelling in the direction $f^1$ it drives the carriage 10 along therewith in the same direction the carriage 10 being urged by the bar 33, the fork 36 and the vertical plate 38 fixed to the carriage 10. Then the carriage 10 comes in contact with the carriage 9 and pushes the latter along in front thereof to the end of the runway 3, in which position the carriage 9 is located just at the entrance of the casing 2.

By retracting the jack 6 the pivotal section 5 of the runway 4 is lowered and this lowers the carriage 10 which then becomes disposed in the recess 19 of the carriage 9. The jaws 16 of the tongs of the extractor which have entered the body of the pipe T, are moved apart and strongly grip the interior of the pipe. The position shown in FIGS. 2 and 2A is now reached and the support rollers 22 and 25 are completely moved apart the rollers 22 by separation and the rollers 25 by descent so as to allow the way free for the exit of the socket of the pipe T. Indeed, this socket must be supported by no rollers, the latter being adapted to support the body part of the pipe T.

b. Extraction of the pipe from the mould (FIGS. 3, 3A, 4, 4A and 6)

The carriage 8 then starts its rearward movement in the direction of arrow $f^2$. The tubular girder 14, the jaws 16 and the pipe T continue to rotate at the rotational speed of the mould 1.

As soon as the pipe T has moved out of the mould 1, while continuing to rotate, to a sufficient extent, that is to say such that the socket E has passed beyond the rollers 25 of the carriage 10, the section 5 is raised and the carriage 10 which had been previously withdrawn downwardly to allow the passage of the socket, places itself in position for supporting the pipe body, one of the rollers 35 being driven in rotation by the motor 28. The disengaged part of the pipe T then bears on these rollers 25. The raising of the carriage 10 is for example produced when the chain 37 is taut and starts to pull on the carriage 10.

When the major part of the body of the pipe T has been disengaged from the mould 1 and the carriage 10 is sufficiently remote from the carriage 9, the brackets 21 of the carriage 9 move back to their operative supporting position. The rollers 22 are then placed under the body of the pipe. This movement of the rollers 22 can be produced for example by the start of the traction of the carriage 9 by the chain 28.

Note that the carriages 9 and 10 are also pulled in the direction of arrow $f^2$ owing to their connection with the pipe T under the effect of the weight of the latter and the traction exerted on this pipe by the extracting carriage 8. Consequently, the force that the chains 28 and 37 must exert is relatively small.

Figure 4A:
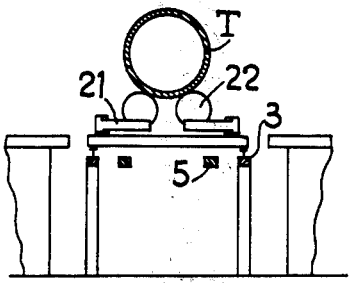
Figure 4:
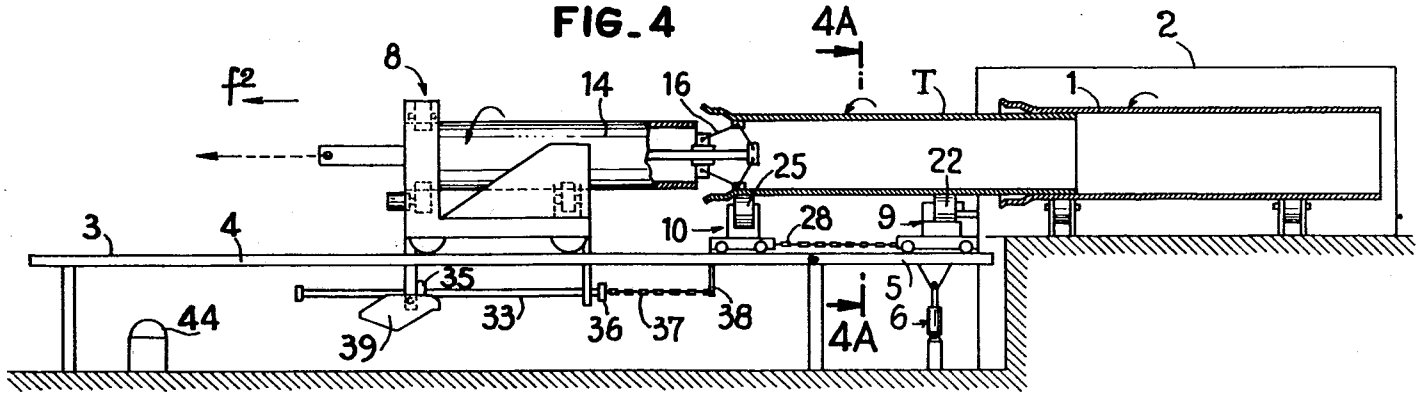

The position shown in FIGS. 4 and 4A is now reached and the whole of the equipment moves in the direction of arrow $f^2$. This movement continues until the pipe is completely extracted from the mould and the shoe 39 in passing over the fixed abutment 44 tips and releases the flange 35 of the bar 32. Simultaneously the jaws 16 are withdrawn and therefore releases the pipe T and the carriage 8 alone continues its rearward travel. The coupling bar 33, retained by the chain 37, is released by the tipping of the shoe 39 and slides in the direction of arrow $f^1$ with respect to the extracting carriage 8. Consequently, the latter moves away from the pipe T until the vertical girder 30 comes in contact with the end abutment 34 of the bar 33. The chain 37 between the carriage 8 and the carriage 10 then again becomes taut and the travel of the extracting carriage ceases, the pipe T being then positioned below the hoisting apparatus L. Note that during this operation the pipe continues to be driven in rotation by a roller 25 of the carriage 10 at the same speed as before.

c. Discharge of the pipe

In this position of the end of the extraction (FIG. 5), the hoisting apparatus L lowers its tongs 45 in their open position. The latter close by placing their rollers 46 (driven in rotation) under the body of the pipe T, one of the tongs being placed between the carriages 9 and 10.

The hoisting apparatus raises the pipe T (still driven in rotation by the rollers 46) and discharges it (FIG. 7).

The rotation of the motors 48 and rollers 46 is stopped only when the pipe T is sufficiently cooled and therefore rigid.

As a new pipe T is cast, the installation is ready for a new extraction by recommencing the cycle described hereinbefore.

The installation according to the invention has the following important advantages:

Owing to the continuous rotation of the pipe T in the course of its extraction, after its complete disengagement from the mould 1, and until its discharge by the hoisting apparatus L, risk of its ovalization is avoided. Such a continuous rotation is obtained by means of the driving motors 15 of the extractor 8 and the driving motors **27*a* and 48 of the support rollers 25 and 46.**

Owing to the mounting of the support rollers 22 and 25 on carriages 9 and 10 and owing to the coupling by flexible ties, such as chains 28 and 37, to the extracting carriage 8, the pipe T is constantly supported as it is disengaged from the mould 1 while any longitudinal friction thereof on the rollers 22 and 25 is avoided since the rollers move in translation in the direction of arrow $f^2$ at the same speed as the extracting carriage 8 and therefore in perfect synchronism with the pipe T. Moreover, it is possible to shift the carriages 9 and 10 by pushing them in the direction of arrow $f^1$ and by pulling on them in the direction of arrow $f^2$, which permits moving them toward each other.

Owing to the pivoted section 5 of the runway 4 and to the jack 6 for lowering this section and owing to the pivotal bracket 31 supporting the rollers 22, a passage is formed for the exit of the socket of the pipe T which socket must not bear on any roller.

Owing to the simplicity and strength of the automatic coupling employing the shoe 39 and the sliding bar 33, it is possible to withdraw the extracting tongs from the pipe T extracted from the mould by a simple uncoupling of the extracting carriage 8. This automatic coupling therefore permits avoiding a telescopic mechanism for entering and withdrawing the tongs by a displacement along the axis X—X.

Owing to the hollow recess 19 of the first carriage 9, it is possible to move the carriage 10 as close as possible to the carriage 9 so as to support the body of the pipe T as soon as a sufficient length of the latter has been extracted.

Thus it can be seen that the pipe T is perfectly supported and driven in rotation throughout its extraction and its discharge so that there is no deformation or deterioration of its surface.

This is particularly advantageous for large diameter pipes, for example pipes of a diameter of 600 mm and more and even up to a diameter of 2,000 mm.

We claim:

1. An installation comprising a rotary mould of a centrifugal casting machine, means for rotating said mould at a given speed and in a given direction about an axis, and means for extracting a cast pipe from the mould, said extracting means comprising an extracting carriage movable parallel to said axis, pipe extracting tongs coaxial with the mould and carried by the carriage, a tubular girder coaxial with the mould and having a diameter substantially equal to the diameter of the cast pipe, the extracting tongs being mounted inside and connected to rotate with the tubular girder and extending beyond an end of the girder adjacent the mould, rotatable rollers carried by the carriage and rollingly supporting the girder adjacent opposite ends of the girder, a motor drivingly connected to at least one of said rollers to drive the girder and tongs in rotation about said axis, and means for synchronizing the speed and direction of rotation of the tongs with the speed and direction of rotation of the mould during pipe extraction.

2. In an installation comprising a rotary mould of a centrifugal casting machine, means for rotating said mould at a given speed and in a given direction about an axis, and means for extracting a cast pipe from the mould, said extracting means comprising an extracting carriage movable parallel to said axis and pipe extracting tongs coaxial with the mould and carried by the carriage, the improvement comprising: a motor carried by the carriage and drivingly connected to the extracting tongs for driving the extracting tongs in rotation about said axis at said given speed and in said given direction during pipe extraction, a hoisting device having openable tongs carrying pipe supporting rollers, at least one of said pipe supporting rollers being provided with means for driving it in rotation at a rotational speed corresponding to the slip-less rolling of the extracted pipe on said pipe supporting roller.

3. An installation comprising a rotary mould of a centrifugal casting machine, means for rotating said mould at a given speed and in a given direction about an axis, and means for extracting a cast pipe from the mould, said extracting means comprising an extracting carriage movable parallel to said axis, pipe extracting tongs coaxial with the mould and carried by the carriage, a tubular girder coaxial with the mould, the extracting tongs being mounted inside and connected to rotate with the tubular girder, rotatable rollers carried by the carriage and rollingly supporting the girder, a motor drivingly connected to at least one of said rollers to drive the girder and tongs in rotation about said axis at said given speed and in said given direction during pipe extraction, a first runway having a wide track and a second runway having a narrow track and disposed inside the first runway, two support carriages carrying rotatable rollers and disposed between the mould and the extracting carriage, a first of said support carriages and the extracting carriage being movable on the first runway and a second of said support carriages being located between the other two carriages on the second runway, the first carriage carrying pivotable support brackets carrying the rollers of the first carriage, the rollers of the first carriage being capable of being selectively put in a position for supporting a body part of the pipe and a position withdrawn from the pipe by pivoting the brackets, the second runway having a pivotal end section which is pivotable downwardly so as to permit withdrawing the rollers of the second carriage from a body part of the pipe.

4. An installation as claimed in claim 3, comprising means for driving in rotation at least one of said rollers of the support carriages at a speed corresponding to the slip-less rolling of the extracted pipe on said one roller.

5. An installation as claimed in claim 3, wherein the first support carriage is provided with a recess adapted to receive at least a part of the second support carriage in the withdrawn position of the rollers of the two support carriages.

6. An installation as claimed in claim 3, comprising chains interconnecting the two support carriages and coupling means coupling both support carriages to the extracting carriage.

7. An installation as claimed in claim 6, wherein said coupling means comprise a coupling bar which is carried by the extracting carriage and parallel to the runways, an abutment on the second support carriage, a thrust member on the bar for exerting a thrust on the abutment of the second support carriage, a chain connecting the thrust member to the abutment, said bar being adapted to slide longitudinally with respect to the extracting carriage and carrying a projecting portion, a tiltable hook connected to the extracting carriage being capable of locking the projecting portion in position.

8. An installation as claimed in claim 7, comprising a fixed abutment which is fixed relative to the mould, the hook being capable of cooperating with the fixed abutment at the end of the pipe extracting travel of the extracting carriage and being tiltable by the fixed abutment to release the projecting portion of the bar.

* * * * *